United States Patent [19]

Katsenes

[11] Patent Number: 4,841,658

[45] Date of Patent: Jun. 27, 1989

[54] QUICK DETACHABLE GUN SLING SWIVEL

[76] Inventor: Philip B. Katsenes, 4633 Via Benito, Santa Barbara, Calif. 93110

[21] Appl. No.: 258,626

[22] Filed: Oct. 17, 1988

[51] Int. Cl.[4] ..... F41C 23/02

[52] U.S. Cl. ..... 42/85

[58] Field of Search ..... 42/85

[56] References Cited

U.S. PATENT DOCUMENTS 3,704,537 12/1972 McKinzie ..... 42/85
4,209,157 6/1980 Edmisten ..... 42/85
4,454,675 6/1984 Ives ..... 42/85
4,505,012 3/1985 Johnson ..... 42/85

FOREIGN PATENT DOCUMENTS 1138193 10/1962 Fed. Rep. of Germany ..... 42/85

*Primary Examiner*—Charles T. Jordan
*Attorney, Agent, or Firm*—William H. Maxwell

[57] ABSTRACT

A quick detachable three axis swivel for attachment of a strap, wherein a link has a coupling pin and with a movable leg carried by a lock pin controlled by movement of a loop to which the strap is secured, characterized by operating, safety and release conditions, and precluding accidental release.

13 Claims, 3 Drawing Sheets

QUICK DETACHABLE GUN SLING SWIVEL

BACKGROUND OF THE INVENTION

This invention relates primarily to guns and the attachment thereto of a sling by which guns are often carried. Long guns such as rifles and shotguns are of particular concern, in which a strap is attached so as to extend loosely between the end portion of the gun stock, or between the butt of the stock and the barrel ahead of the stock. Accordingly, it has been common practice to install spaced fittings at these positions to receive a pair of spaced swivels and each with a loop to secure the opposite ends of the sling. The sling is most often a leather strap with a buckle or the like for adjustment. The purpose of the sling is for convenience in transporting the gun, and it is often desired that the sling be removed when the gun is in use. Therefore, releasable swivels have been used wherein a link part is shiftable as by manual depression, to open and close the link. However, prior art links have been subject to accidental release, as for example when a hunter is hiking over rough terrain and he accidentally bumps and releases the link of the swivel, or when the gun pulls laterally and releases the link, thereby dropping the gun from one or the other end of the sling. It is a general object of this invention to prevent such an accidental release of the sling, while providing a quick release function of a swivel that reliably secures the sling to the gun stock.

Swivels of the type under consideration are characterized by a link to which a loop is pivotally attached to receive an end of the sling, and it is usually preferred that the link be a rigid unitary part. That is, there are usually two parts involved, namely the link and the loop. However, to render such a swivel releasable, the link is made separable, and for example one leg thereof is made movable relative to the other leg thereof, in order to release the link from the base fitting that is permanently attached to the gun. In the past, this movement has been a lateral movement of one leg held closed to the other leg by spring pressure, and this manner of engagement has led to accidental release. Therefore, it is an object of this invention to provide a locking condition controlled by articulation of the loop which prevents accidental release of the link. It is also an object of this invention to lock the loop to the link so that they operate as a rigid unit, and it is still another object of this invention to provide a secondary lock or safety that prevents a primary lock from releasing the link. As shown, the swivel of the present invention is characterized by a link body with a rigid leg, and a movable leg released by a lock pin, and a loop controlling the primary and secondary locking functions which preclude accidental release of the movable leg by the lock pin.

The quick detachable swivel is disclosed herein in two forms, one which is rigid and the other which is articulated, and both retaining the primary and secondary safety lock features as set forth above. In carrying out this invention there is a lock pin that carries the movable leg of the link and which has a spool portion having a closed operating link position, a first intermediate safety position, and an open releasing link position. In accordance with this invention, said first and second positions are controlled by the selective positioning of the loop member of the swivel. In a normal or substantially normal operating position the loop member limits positioning of the lock pin to the closed link and said first intermediate position where the movable leg remains inseparable from the link configuration. However, by selectively positioning the loop member, as is shown and hereinafter described, said second position is attainable so that the movable leg is separable from the closed link configuration to open the swivel for its release from the base fitting.

SUMMARY OF THE INVENTION

The swivel herein disclosed is quickly detachable and is characterized by a link that is releasable from a base and by a loop that secures a strap, in this case a gun strap. The strap inherently pulls in alignment with the swivel whether rigid or articulated, the strap being adjustably buckled and not readily removable from the loop of the swivel. The swivel has three pivotal axes a, b and c; axis a having a coupling pin engageable through the base, axis b having a lock pin, and axis c having a pivot pin that carries the loop. In addition to the three pins, the swivel is comprised of three structural members, a link body with a rigid coupling leg, a movable coupling leg, and the loop which receives the strap. A feature is the accessibility of a head portion of the lock pin, the portion thereof which is manually depressible from an operating postition to a safety position, and then to a release position; all of which is controlled by positioning of the loop. As will become apparent from the drawings and following description, the swivel remains locked when the loop is in alignment with the link body, the loop including a lever that disengageably controls the lock pin so as to impose a safety condition when in alignment with the link body, and so as to release the lock pin when angularly disposed to the link body. Operation of both the lock pin and controlling link must be by manual deliberation.

The foregoing and various other objects and features of this invention will be apparent and fully understood from the following detailed description of the typical prefered forms and applications thereof, throughout which description reference is made to the accompanying drawings.

THE DRAWINGS

Figure 6:
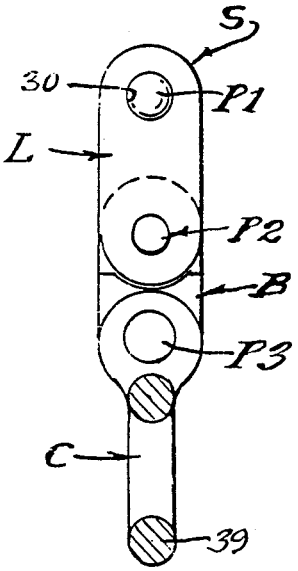
Figure 5:
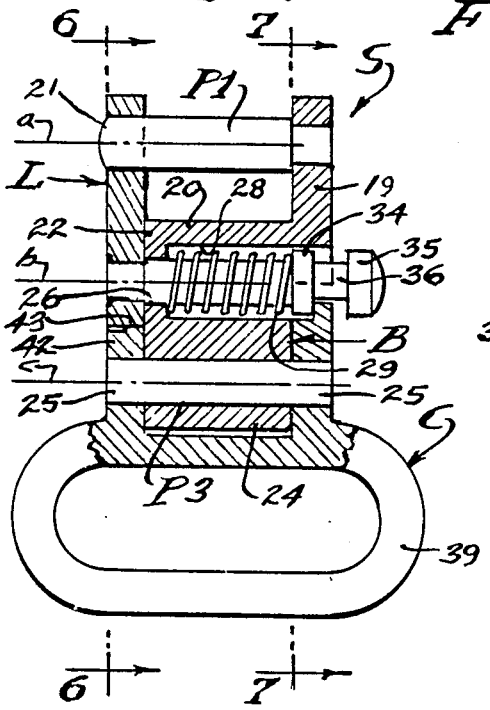
Figure 7:
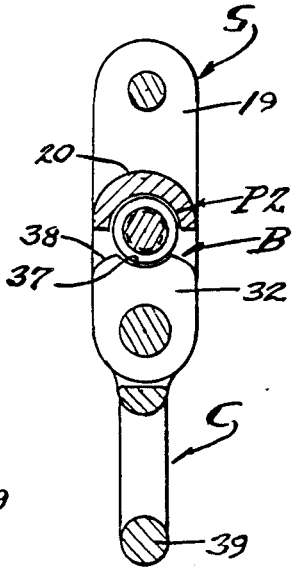

FIGS. 5, 6 and 7 are views which show a first embodiment and the locked condition of the swivel, FIG. 5 being a transverse sectional view, and FIGS. 6 and 7 being taken by lines 6—6 and 7—7 on FIG. 5.

Figure 8:
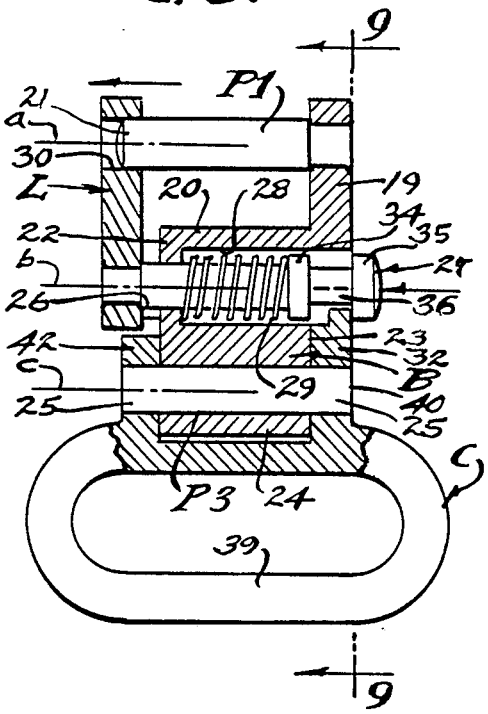
Figure 9:
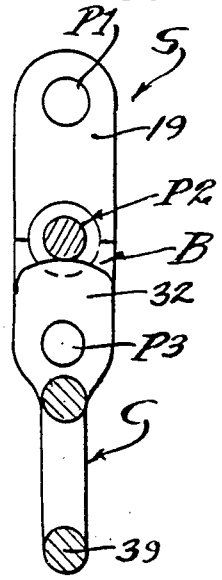
Figure 10:
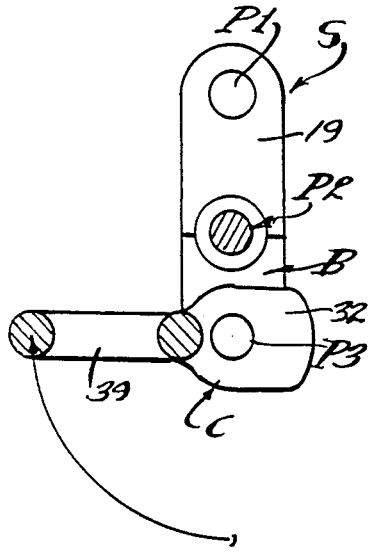

FIGS. 8, 9 and 10 are views which show the safety condition of the swivel, FIG. 8 being a transverse sectional view with the control member in an operating position, FIG. 9 being taken by lines 9—9 on FIG. 8, and FIG. 10 being a view similar to FIG. 9 and showing the control member in the release position.

Figure 11:
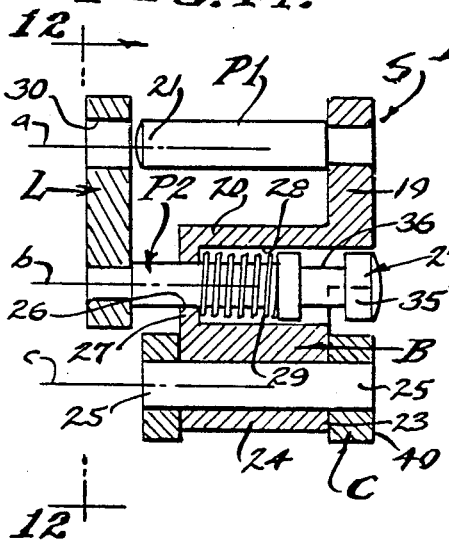
Figure 12:
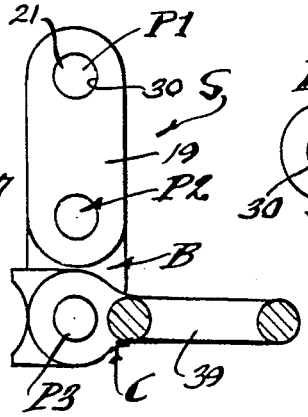
Figure 13:
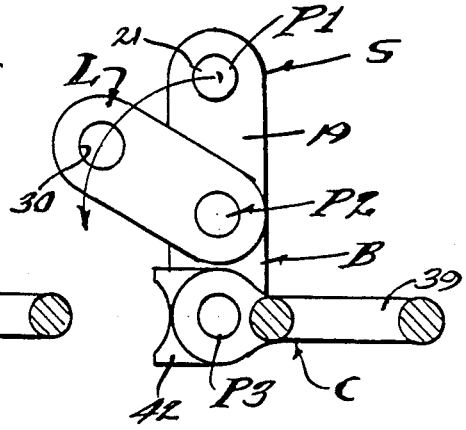

FIGS. 11, 12 and 13 are views which show the released condition of the swivel, FIG. 11 being a transverse sectional view with the control member in the release position being taken by lines 12—12 on FIG. 11, and FIG. 13 being a view similar to FIG. 12 and showing the control member and leg member in the release position.

Figure 14:
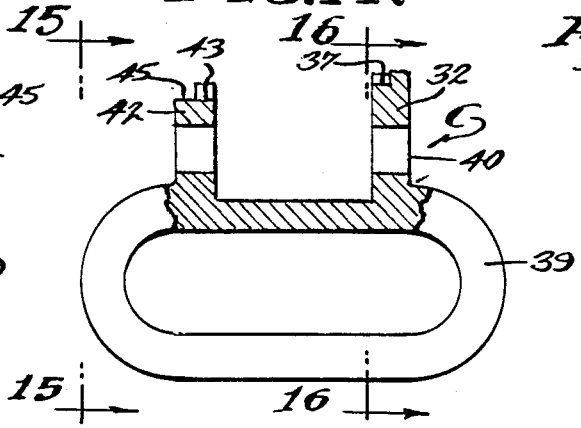
Figure 15:
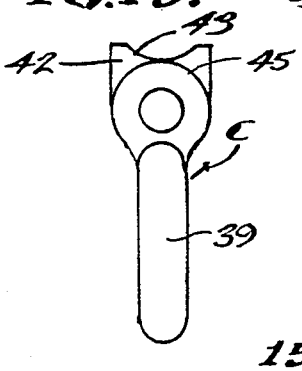
Figure 16:
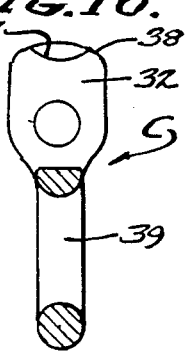

FIGS. 14, 15 and 16 are views which show the loop member of the swivel removed from the assembly, FIG. 14 being a transverse view thereof, and FIGS. 15 and 16 being taken be lines 15—15 and 16—16 on FIG. 14.

Figure 17:
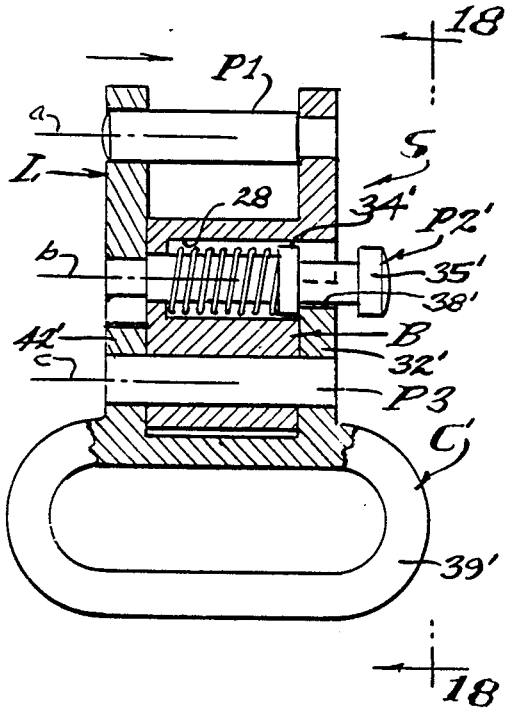
Figure 18:
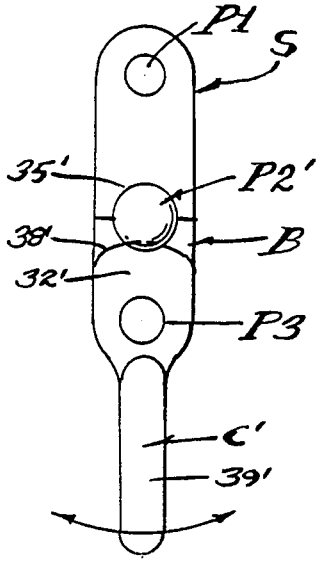
Figure 19:
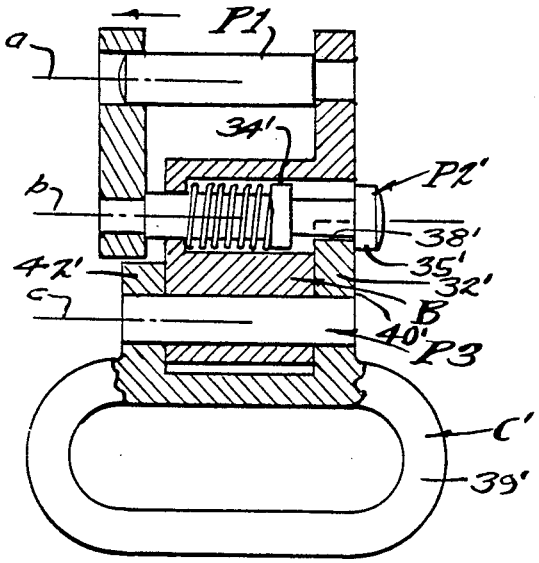
Figure 20:
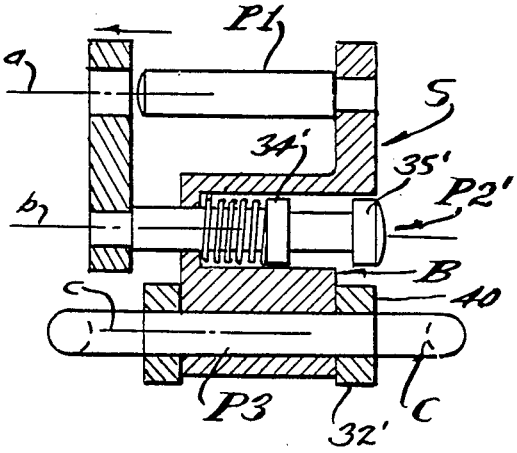
Figure 21:
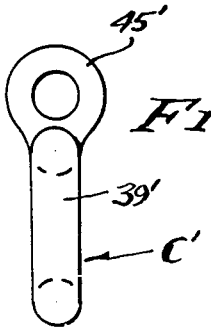
Figure 22:
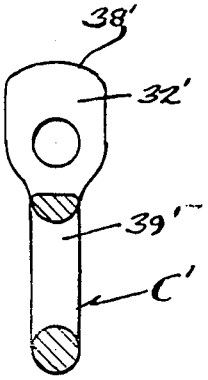

FIGS. 17 through 22 are views which show a second embodiment, FIG. 17 being similar to FIG. 5 and showing the locked condition of the swivel, FIG. 18 being taken by line 18—18 on FIG. 17 and showing articulation of the loop, FIG. 19 showing the safety condition, and FIG. 20 showing the released condition. FIGS. 21 and 22 are views similar to FIGS. 15 and 16, and show the controlling features of the loop employed in the second embodiment.

Figure 23:
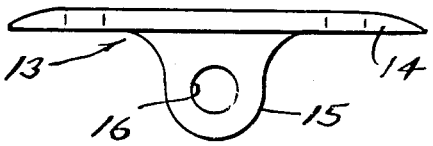

FIG. 23 is a side elevation of the base fitting to which the swivel is detachably secured.

PREFERRED EMBODIMENTS

Figure 1:
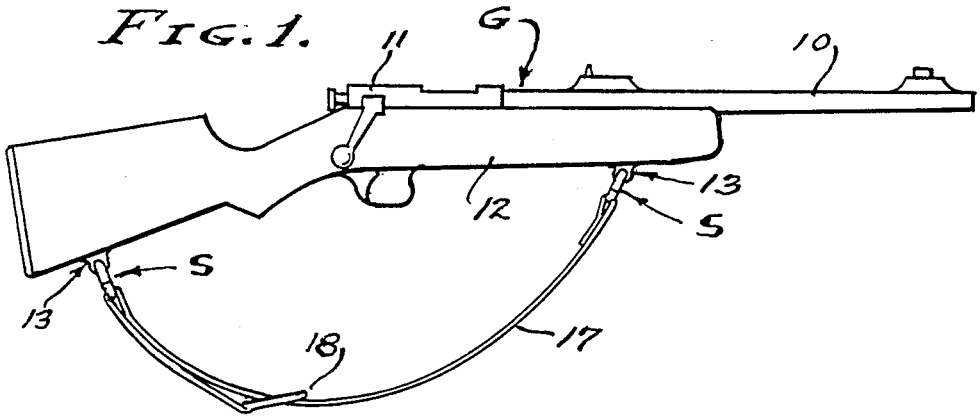
FIG. 1 shows the Quick Detachable Gun Sling Swivels as they are installed onto the stock of a typical gun.

Referring now to the drawings, a typical gun G is shown in FIG. 1, having a barrel 10 with a bolt action 11 carried by a stock 12. At opposite end portions of the stock base fittings 13 are permanently installed to receive the swivels S of the present invention. As shown in FIG. 23 the base fitting 13 is comprised of a pad 14 for mounting to the gun stock 12, and an ear 15 with an opening 16 through which a coupling pin of the swivel is engaged. A strap 17 with opposite end swivels S is detachably secured to the spaced base fittings 13, there being a buckle 18 for adjustment of the strap.

Figure 2:
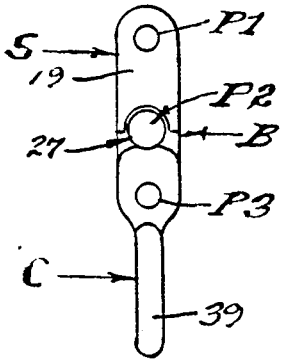
FIGS. 2, 3 and 4 are side views of the swivel removed from the gun and sling, FIG. 2 showing the locked condition thereof, FIG. 3 showing articulation of the loop that releases the safety, and FIG. 4 showing the released condition thereof.
Figure 3:
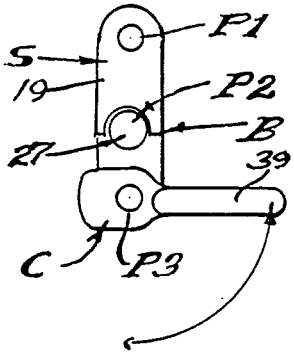
Figure 4:
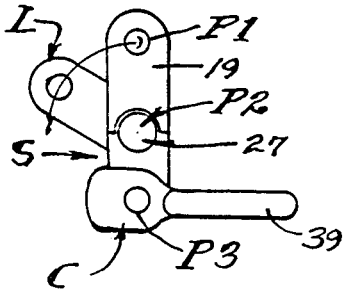

FIGS. 2, 3 and 4 show the three conditions of the swivel S. In FIG. 2 the aligned operating condition is shown, wherein the movable leg of the swivel is closed over the coupling pin and said movable leg; all as shown in FIG. 5. In FIG. 3 the intermediate safety condition is shown, wherein the movable leg remains engaged over the coupling pin under control of the lock pin by the loop member; all as shown in FIG. 8. And, in FIG. 4 the released condition is shown, wherein the movable leg is free of the coupling pin under control of the lock pin by the loop member; all as shown in FIG. 11. It is the rotative position of the loop member which controls the lock pin to attain the three positions shown, namely an operating position, a safety position, and a release position.

This quick detachable swivel S is comprised generally of three members, a link body member B, a movable leg member L, and a control member C. The three members B, L and C are assembled on three pivotal axes a, b and c; there being a coupling pin P1 on axis a, a lock pin P2 on axis b, and a pivot pin P3 on axis c. The relationship of said axes and pins is best shown in FIGS. 5, 8 and 11 of the drawings.

The link body member B is regarded as a vertically disposed member through which the three axes a, b and c extend in parallel relation, the coupling axis a being uppermost, the pivot axis c being lowermost, and the lock pin axis b being intermediate the two. The three axes and said pins are in a common transverse plane, as shown throughout the drawings. A feature of the member B is that it carries an upwardly projecting leg 19 at one side thereof, the movable leg L being carried by the lock pin P2 at the other side thereof (see FIGS. 5, 8, and 11). The intermediate portion 20 of member B carries the lock pin P2 on the axis b, from which the leg 19 projects to carry the coupling pin P1 in spaced relation to said portion 20. The coupling pin P1 is permanently secured to the leg 19 to cantilever therefrom and with its free end portion 21 terminating beyond the side face 22 of member B opposite the side face 23 from which leg 19 projects. The lower portion 24 of member B receives the pivot pin P3, as by means of a press fit, with its opposite ends 25 projecting as trunnions from the side faces 22 and 23, to rotatably carry the control member C. It is to be understood that the coupling pin P1 can be carried by the movable leg L, though it is preferred to be carried as shown.

The lock pin P2 is slidably carried in a bore 26 on the axis b, said bore entering through the side face 22 of member B. The lock pin P2 projects from side face 22 to rotatably carry the movable leg L, being affixed to said leg. The pivot pin P2 cantilevers from the movable leg so as to extend to and beyond the side face 23 of member B where it is characterized by a controlling head portion 27 of enlarged spool configuration, there being a counterbore 28 to slidably receive said head portion. A compression spring 29 seats in the counterbore and yieldingly urges the head portion into the operating position shown in FIG. 5, with the movable leg L stopped against side face 22 of member B. As shown, the movable leg L has an opening 30 that engages fully over the free end portion 21 of coupling pin P1, thereby closing the swivel S in its operating condition with the coupling pin P1 engaged through opening 16 in the base fitting 13, for example.

The spool-shaped head portion 27 of lock pin P2 releasably embraces a safety lever 32 of the control member C, as will be described. The head portion 27 has an inner flange 34 outside the side face 23 to intercept the lever 32, and it has an outer flange 35 normally spaced from the outside of the lever, as will be described. The spool configuration of the head portion also has a reduced diameter 36 between said flanges to clear the lever 32.

In accordance with the first embodiment, the control member C in the form of lever 32 controls sliding of lock pin P2, and said lock pin controls positioning of said lever. In FIGS. 5 and 7 the operating condition is shown wherein the inner flange 34 of the spool-shaped head portion 27 fits into a complementary recess 37 in the end 38 of lever 32, while said end clears the spool diameter 36. The safety lever 32 is a first class lever comprised of an upstanding leg pivoted on the axis c and integral with a diametrically opposite loop 39 through which the strap 17 is secured. The loop and lever are rotated on the supporting trunnion 25 at the side face 23 of member B, so as to be manipulated when released by lock pin P2 as shown in FIGS. 8–10. The safety condition is shown in FIGS. 8 and 9, wherein the inside of outer flange 35 of the spool-shaped head portion 27 stops against the outside 40 of lever 32, simultaneously with removal of flange 34 from the recess 37, whereupon the safety condition can be released as shown in FIG. 10. In practice, the width of lever 32 is less than its length from axis c to end 38, so that rotation in either direction to a position as shown in FIG. 10 removes the end portion 38 of lever 32 from confinement between the spaced flanges, whereupon the lock pin P2 can be shifted to the release condition as shown in FIGS. 11–13. As clearly shown in FIG. 11, the head portion 27 is depressed sufficiently to remove leg L from the coupling pin, so that it can then be rotated as shown in FIGS. 4 and 13, whereupon the coupling pin P1 can be withdrawn from the opening 16 of base fitting 13.

Engagement of flange 34 in recess 37 prevents accidental movement of the control member C. Accidental movement of control member C is also precluded by a similar configuration of parts at the opposite side face 22 of member B where a lever 42 integral with the loop 39 rotates on a supporting trunnion 25. As shown in FIGS. 5 and 6, the arcuate lower end of leg L fits into a complementary recess 43 at the end 44 of lever 42. The lever 42 is a first class lever integral with lever 32 above described, to rotate therewith, so that shifting of lock pin P2 to the position shown in FIG. 8 permits rotation of lever 42 in either direction as shown in FIGS. 10, 12 and 13. Thus, the recesses 32 and 43 of control member C are made free from the restrictive engagement of flange 34 and lower end of leg L.

Referring now to the control member C as it is shown in FIGS. 14–16, the recess 37 is at the inside of lever 32 in the end 38 thereof, so that the outside 40 of the lever engages the stop flange 35 of the spool-shaped head portion 27 (see FIGS. 14 and 16). And, the recess 43 is at the inside of lever 42, the axial depth of the recesses 32 and 43 being the same, so that the flange 34 and bottom of leg L are simultanesouly released by the lock pin P2. The end 38 is greater in radius from axis c than is the recess 32, while the lever 42 has a hub 45 of lesser radius from axis c, so as to clear the bottom end of leg L. The hub 45 is at the outside of lever 42.

The second embodiment shown in FIGS. 17–22 is the same as the first embodiment hereinabove described, except for the placement of the inner flange 34' and the elimination of recesses 37 and 43. The purpose of these modifications is to permit articulation or swinging of the control member C', as shown by the double ended arrow in FIG. 18. The operating condition is shown in FIG. 17, similar to FIG. 5, the flange 34' being inside the counterbore 28 of member B so as to be clear of the end 38' of safety lever 32'. Note the lever 32' has no end recess and is therefore free to articulate and swing. Likewise, the hub 45' is devoid of an end recess, and it too is therefore free to articulate and swing. Since the levers 32' and 42' are integral with the loop 39', they articulate and swing together. The safety condition is shown in FIG. 19, where the stop flange 35' engages the stop face or outside 40' of safety lever 32'. The release condition is shown in FIG. 20 where the safety lever 32' is rotated away from the stop flange 35', whereby the leg L is moved free from the coupling pin P1 so as to release the swivel as above described. FIG. 21 shows the absence of a recess at the arcuate end of hub 45', and FIG. 22 shows the absence of a recess at the arcuate end 38' of lever 32'.

It will be understood from the foregoing that a safety condition is provided in this quick detachable swivel, whereby accidental release is precluded. Only by manual deliberation can the angular positioning of the control member C or C' be coordinated with the further depression of the lock pin P2 or P2' from its safety condition, and only after the first partial depression of the lock pin can complete release occur.

Having described only the typical preferred forms and applications of my invention, I do not wish to be limited or restricted to the specific details herein set forth, but wish to reserve to myself any modifications or variations that may appear to those skilled in the art, as set forth within the limits of the following claims.

I claim:

1. A detachable swivel having an operating condition, a safety condition and a release condition, for releasably coupling a strap and the like to a base fitting and the like, and including:

a link body member having three spaced and parallel axes disposed in a common transverse plane, a coupling pin carried thereby on an uppermost axis, a pivot pin carried thereby on a lowermost axis, and a lock pin carried thereby on an instermediate axis, and a leg carried at one side of said member and carrying the coupling pin cantilevered therefrom to project beyond the other side of said member, a movable leg carried by the lock pin to engage said other side of the link body member when in the operating condition and having an opening engaged over an end of the coupling pin to embrace the base fitting when engaged over the coupling pin, and a control member rotatable on the pivot pin and comprised of a depending loop to receive the strap and an upstanding safety lever to releasably engage a head portion on the lock pin, the lock pin being slidable in the link body member on the axis thereof and rotatably carrying the movable leg, and the head portion of the lock pin having a flange spaced from the safety lever when in an operating position and engageable therewith when depressed to a stopped safety position, the control member being rotatable to remove the safety lever from the lock pin flange so as to release said pin and movable leg for disengagement of the latter from the coupling pin.

2. The detachable swivel as set forth in claim 1, wherein the lock pin and movable leg carried thereby are yieldingly biased by a spring into said operating position.

3. The detachable swivel as set forth in claim 1, wherein the link body member is counterbored over the lock pin to carry and seat a spring yieldingly engaged with the head portion of the lock pin to urge said pin and movable leg into said operating position.

4. The detachable swivel as set forth in claim 1, wherein the movable leg is affixed to the lock pin to slide and rotate therewith.

5. The detachable swivel as set forth in claim 3, wherein the head portion of the lock pin is spool-shaped having inner and outer flanges and with a reduced diameter therebetween, the inner flange being seated with the spring and the outer flange being engageable with the safety lever, and the reduced diameter clearing the safety lever.

6. The detachable swivel as set forth in claim 1, wherein the loop and safety lever form a first class lever that swings in either direction from an aligned relationship with the link body member, to release the lock pin from the safety position.

7. The detachable swivel as set forth in claim 1, wherein the safety lever has an end with a recess to receive the head portion of the lock pin, to hold the control member in alignement with the link body member when in the operating position.

8. The detachable swivel as set forth in claim 1, wherein the control member has a lever with a recess to receive a portion of the movable leg, to hold the control member in alignment with the link body member when in the operating position.

9. The detachable swivel as set forth in claim 1, wherein the control member safety lever at one side thereof has a recess to receive the head portion of the lock pin, and has a lever at the other side thereof with a recess to receive a portion of the movable leg, to hold the control member in alignment with the link body member when in the operating position.

10. The detachable swivel as set forth in claim 1, wherein the link body member is counterbored over the lock pin to carry and seat a spring yieldingly engaged with the head portion of the lock pin to urge said pin and movable leg into said operating position, wherein the head portion of the lock pin is spool-shaped having inner and outer flanges and with a reduced diameter therebetween, the inner flange being seated with the spring and the outer flange being engageable with the safety lever and the reduced diameter clearing the safety lever, the safety lever having an end with a recess to receive the inner flange of the head portion of the lock pin, to hold the control member in alignment with the link body member when in the operating condition, the inner flange being shiftable from the recess in the safety position to permit rotation of the control member to the release condition for further shifting of the link pin and removal of the movable leg from the coupling pin.

11. The detachable swivel as set forth in claim 1, wherein the link body member is counterbored over the lock pin to carry and seat a spring yieldingly engaged with the head portion of the lock pin to urge said pin and movable leg into said operating position, wherein the head portion of the lock pin is spool-shaped having inner and outer flanges and with a reduced diameter therebetween, the inner flange being seated with the spring and the outer flange being engageable with the safety lever and the reduced diameter clearing the safety lever, the control member safety lever at one side thereof having a recess to receive the inner flange of the lock pin, and having a lever at the other side thereof with a recess to receive a portion of the movable leg, the inner flange and movable leg being shiftable from their respective recesses to permit rotation of the control member to the release condition for further shifting of the lock pin and removal of the movable leg from the coupling pin.

12. The detachable swivel as set forth in claim 3, wherein the head portion of the lock pin is spool-shaped having inner and outer flanges and with a reduced diameter therebetween, the inner flange being seated with the spring and the outer flange being engageable with the safety lever in its operating position and clearing the safety lever when the control member and safety lever are rotated to release the lock pin.

13. The detachable swivel as set forth in claim 12, wherein the loop and safety lever form a first class lever that swings in either direction from an aligned relationship with the link body member, to release the lock pin from the safety position.

* * * * *